United States Patent [19]

Adam

[11] Patent Number: 4,709,127

[45] Date of Patent: Nov. 24, 1987

[54] CONTACT ARRANGEMENT WITH SPACERS SEPARATING CONTACT LEVERS FROM EACH OTHER

[75] Inventor: Bernd Adam, Berlin, Fed. Rep. of Germany

[73] Assignee: Siemens Aktiengesellschaft, Munich, Fed. Rep. of Germany

[21] Appl. No.: 922,682

[22] Filed: Oct. 24, 1986

[30] Foreign Application Priority Data

Nov. 7, 1985 [DE] Fed. Rep. of Germany ..... 3539788

[51] Int. Cl.[4] ..... H01H 33/12

[52] U.S. Cl. ..... 200/146 R

[58] Field of Search ..... 200/146 R

[56] References Cited

U.S. PATENT DOCUMENTS 3,402,274 9/1968 Bould ..... 200/146 R 4,242,577 12/1980 Maier et al. ..... 200/153 R

*Primary Examiner*—Robert S. Macon

*Attorney, Agent, or Firm*—Kenyon & Kenyon

[57] ABSTRACT

A contact arrangement for a low-voltage circuit breaker comprises a movable part having several contact levers. For preventing undersirable deflection of a joint pin going through the contact levers, support levers are arranged between the contact levers, which include openings for the joint pin of the contact levers and a coupling pin which serves for introducing a driving force by coupling members. Between the contact levers, there are furthermore spacers which are supported tiltably within limits at the support levers and which ensure low-friction mobility of the contact levers relative to each other.

3 Claims, 4 Drawing Figures

CONTACT ARRANGEMENT WITH SPACERS SEPARATING CONTACT LEVERS FROM EACH OTHER

BACKGROUND OF THE INVENTION

The present invention relates to a contact arrangement for a low voltage circuit breaker having a fixed part and a movable part, where the movable part comprises at least one burn-off contact lever and at least two main contact levers which, together with spacers separating the contact levers, are tiltably arranged on a tiltably supported holder relative to the holder, and the holder is connected to an actuating device by a coupling member.

A contact arrangement of this type has become known, for instance, through U.S. Pat. No. 3,402,274. In this contact arrangement, the spacers cause a separation of the contact levers to such an extent that the current paths of the adjacent contact levers are separated from each other. This is desirable to avoid eddy currents within the contact arrangement.

The advantages of the spacers between the contact levers are counterbalanced by an undersirable increase of the support span of the bearing pin, whereby the deflection for a given cross section is increased. Such deflection brings with it problems which are greater as the width of the contact arrangement increases, i.e., the greater the number of contact levers required. For example, the deflection of the bearing pin has an effect in the sense of an uneven distribution of the contact forces which results in strong local temperature rises.

SUMMARY OF THE INVENTION

Starting from this, it is an object of the present invention to prevent an undesirable deflection of the bearing pin of the contact levers, with the amount of additional material being kept as small as possible.

The above and other objects of the present invention are achieved by a contact arrangement for a low-voltage circuit breaker with a fixed part and a movable part where the movable part comprises at least one burn-off contact lever and at least two main contact levers which are tiltably arranged on a tiltably supported holder relative to the holder about a joint pin and the holder is connected via a coupling means to an actuating device, spacers being designed as support members being provided which are arranged between the bearing pin and a coupling pin connecting the holder flexibly to the coupling means. In this manner, the coupling pin can be utilized as a part needed anyhow for supporting the bearing pin of the contact levers, without the need to increase the cross section of the bearing pin.

A contribution to the desired equalization of the contact can further be made by the provision that each support member has a support lever exerting the support action itself and has a spacer which is movable relative to the support lever. This arrangement permits bracing the contact levers on a relatively large part of the surfaces facing each other without thereby causing troublesome frictional forces. The latter are decreased considerably by the mobility of the spacers.

The mobility of the spacers can be achieved in a surprisingly simple manner by the provision that each support lever has a part which surrounds the bearing pin concentrically with a circular arc of more than 180° and the spacer has a recess extending beyond the concentric part of the support lever. The desired limitation of the mobility of the spacer can be achieved by a suitable design of the aperture angle of the recess of the spacer.

Nonmagnetic steel, for instance, is suitable as the material for fabricating the support levers and the spacers. This material, besides having great mechanical strength, has the property of relatively low electrical conductivity whereby the formation of a current path extending transversely to the intended direction of the current within the contact arrangement is largely prevented. The support levers and the spacers can further be made of different materials, for instance, of sheet steel and of brass.

BRIEF DESCRIPTION OF THE DRAWINGS

The invention now will be explained in greater detail in the following with the aid of the embodiment shown in the figures in which.

DETAILED DESCRIPTION

Figure 1:
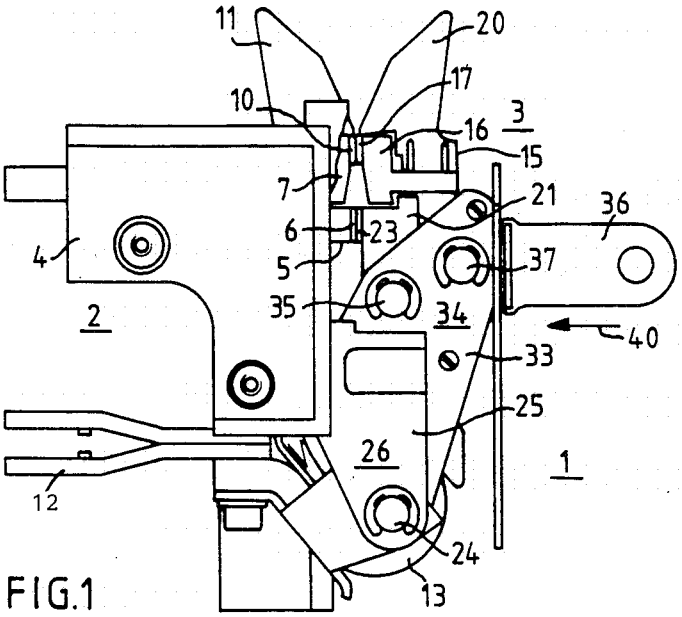
FIG. 1 shows a contact arrangement of a low-voltage circuit breaker in a side view.
Figure 2:
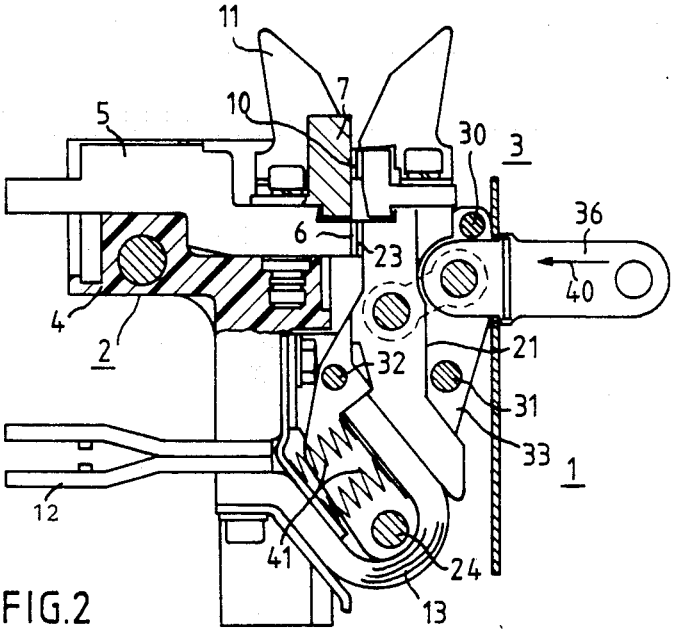
FIG. 2 shows the contact arrangement according to FIG. 1 in a partly cross-sectional side view.
Figure 3:
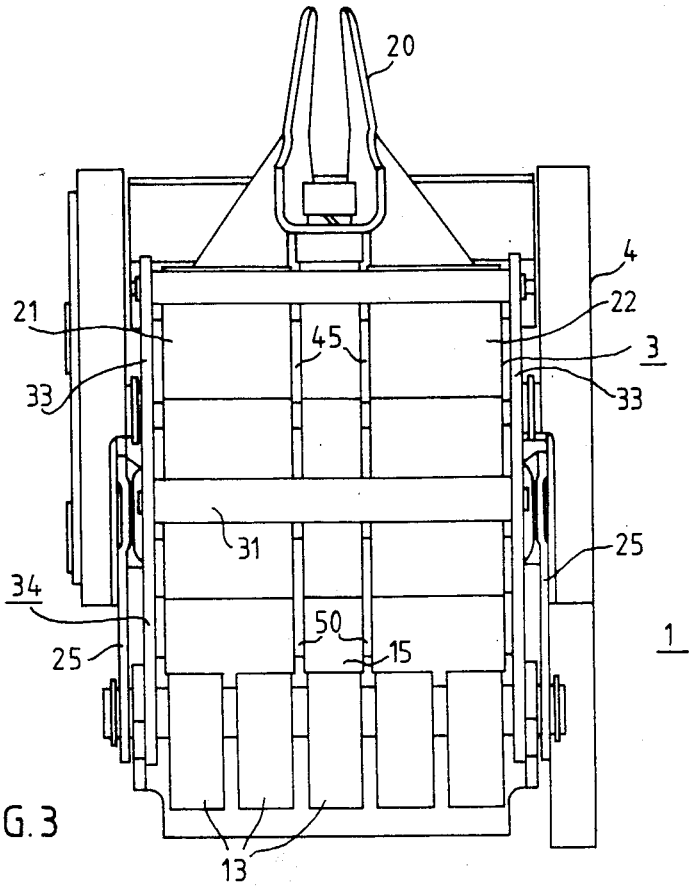
FIG. 3 is a front view of the movable part of the contact arrangement according to FIGS. 1 and 2.

The contact arrangement 1 shown in FIGS. 1, 2 and 3 comprises a fixed part 2 and a movable part 3. An insulating block 4 which has an approximately angular cross section functions as a support for the fixed parts. To the top side of the insulating block 4, a main contact body 5 with contact overlay 6 is fastened which serves at the same time as the upper connecting bar. A fixed burn-off contact 7 having contact overlay 10 as well as an arcing horn 11 is in conducting connection with the main contact body 5. On the underside of the insulating block 4 a forked connecting bar 12 is fastened to which a flexible current-carrying ribbon 13 is connected.

The flexible current-carrying ribbon 13 forms a movable electrical connection between the fixed part 2 and the movable part 3 of the contact arrangement 1. The movable part 3 has a central burn-off contact lever 15 with a burn-off contact 16 as well as a contact overlay 17 and an arcing horn 20. On both sides of the burn-off contact lever 15 there are main contact levers 21 and 22 which are likewise provided with contact overlays 23. As shown particularly in FIG. 3, a total of five flexible current- carrying ribbons 13 are provided and more specifically, two for each of the main contact levers 21 and one current carrying ribbon for the burn-off contact lever 15.

The tilting axis of the movable part 3 of the contact arrangement 1 is formed by a pivot pin 24, the ends of which engage lateral legs 25 of a bearing bracket 26 which is fastened to the insulating block 4. The joint pin 24 further goes through side walls 33 connected by bolts 30, 31 and 32, of a holder 34 which receives the contact levers. The latter are mounted on a common bearing pin 35 which serves as the pivot bearing and the ends of which are supported in the side walls 33 of the holder 34. For transmitting a drive motion to the movable part of the contact arrangement 1 serve insulating coupling members 36 which are omitted in FIG. 3 for imprcving the clarity of presentation. The coupling members 36 engage flexibly a coupling pin 37, the ends of which are likewise supported in the side walls 33 of the holder 34.

The movable part 3 of the contact arrangement 1 is placed into the on-position shown by a motion of the coupling members 36 in the direction of the arrow 40 shown in FIGS. 1 and 2.

By tension of compression springs 41 arranged between the legs of the U-shaped current carrying ribbons 13, the required contact pressure between the contact overlays 6 and 23 as well as 10 and 17 is generated. For switching off, the coupling members 36 are released by unlatching a suitable control shaft, not shown, whereby the movable part 3 of the contact arrangement 1 is placed into its off position.

Essential for a low-loss current passage between mutually opposite fixed and movable contacts is a uniform distribution of the contact forces onto the individual contacts.

Figure 4:
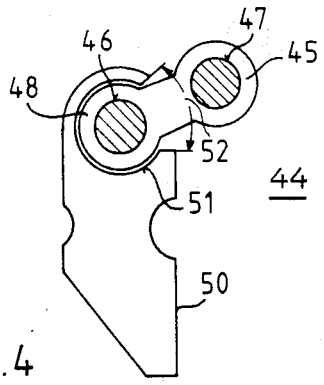
FIG. 4 shows a support member comprising a support lever and a spacer.

To this end, support members 44 comprising support levers 45 are arranged between the burn-off contact lever 15 and the main contact levers 21 adjacent on both sides, which are shown dashed in FIG. 2, and are shown on an enlarged scale separately in FIG. 4. The support levers 45 have bearing openings 46 and 47 for the passage of the joint pin 35 and the coupling pin 37, respectively. In this manner, the coupling pin 37 is utilized for supporting the joint pin 35. Between the burn-off contact lever 15 and the main contact levers 21, there are furthermore located spacers 50 which cover a substantial part of the mutually facing sides of the contact levers. This prevents jamming the contact levers under the influence of current forces.

Nevertheless, the contact levers can move largely independently of each other, as is desirable for a uniform distribution of the contact forces because the spacers 50 between the burn-off contact lever 15 and the main contact levers 21 are movable. This is achieved by the provision that the support levers 45 are used as pivots of the spacers 50 in a manner particularly seen from FIG. 4. To this end, every support lever 45 is provided concentrically with the bearing opening 46 provided for the joint pin 35 with a circular part 48, the circular arc extending over more than 180°. The spacers 50 have a recess 51 matched to this circular-arc shape, of which the opening designated by an arc arrow 52 shown in FIG. 4 is designed so that the support lever 45 and the spacer 50 can execute a limited tilting motion against each other which needs to be only a few angular degrees. On the other hand both parts cannot be separated from each other as long as both lie in the same plane.

As already mentioned, a nonmagnetic steel which, due to its alloy components, has at the same time a relatively low electric conductivity, is particularly well suited for fabricating the support lever 45 as well as the spacer 50. Different materials can also be employed such as nonmagnetic steel for the support levers 45 and brass or insulating material for the spacers 50.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A contact arrangement for a low-voltage circuit breaker comprising a fixed part and a movable part, the movable part comprising at least one burn-off contact lever and at least two main contact levers, said main contact levers being tiltably disposed on a holder, said holder being tiltably disposed about a first bearing pin, said main contact levers being tiltably disposed on said holder about a second bearing pin, said holder being coupled by a coupling means to an actuating device, and further comprising spacer means disposed between ones of said main and burn-off contact levers comprising a support member arranged between the second bearing pin and a coupling pin for connecting the holder flexibly to the coupling means.

2. The contact arrangement recited in claim 1, wherein each support member comprises a support lever for exerting a supporting force on said second bearing pin, said support lever being coupled to the coupling means by said coupling pin, and further comprising a spacer movable relative to the support lever.

3. The contact arrangement recited in claim 2, wherein the support lever includes a part concentrically surrounding said second bearing pin with a circular arc having more than 180°, and the spacer includes a recess receiving said part of the support lever concentrically surrounding the second bearing pin whereby said spacer can move with a limited tilting motion about said part of said support lever.

* * * * *